US010574001B2

(12) United States Patent
Data et al.

(10) Patent No.: US 10,574,001 B2
(45) Date of Patent: Feb. 25, 2020

(54) HIGH POWER ELECTRICAL CONNECTOR

(71) Applicant: Molex, LLC, Lisle, IL (US)

(72) Inventors: Mark Data, Bolingbrook, IL (US); Jengde Lin, Auburn Hills, MI (US); Chiu-Ming Lu, Lisle, IL (US); Arvind Patel, Naperville, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/069,316

(22) PCT Filed: Jan. 13, 2017

(86) PCT No.: PCT/US2017/013364
§ 371 (c)(1),
(2) Date: Jul. 11, 2018

(87) PCT Pub. No.: WO2017/123890
PCT Pub. Date: Jul. 20, 2017

(65) Prior Publication Data

US 2019/0027871 A1 Jan. 24, 2019

Related U.S. Application Data

(60) Provisional application No. 62/278,214, filed on Jan. 13, 2016.

(51) Int. Cl.
*H01R 13/6592* (2011.01)
*H01R 13/6596* (2011.01)
(Continued)

(52) U.S. Cl.
CPC ..... *H01R 13/6592* (2013.01); *H01R 13/15* (2013.01); *H01R 13/5202* (2013.01);
(Continued)

(58) Field of Classification Search
CPC .... H01R 13/15; H01R 13/5202; H01R 13/53; H01R 13/627; H01R 13/639; H01R 13/6592; H01R 13/6596
See application file for complete search history.

(56) References Cited

U.S. PATENT DOCUMENTS 3,448,430 A * 6/1969 Kelly ..... H01R 9/05 439/607.52
3,622,952 A * 11/1971 Hilbert ..... H01R 13/6592 174/78
(Continued)

FOREIGN PATENT DOCUMENTS

JP 2011-081957 A 4/2011
JP 2014-154255 A 8/2014

*Primary Examiner* — Oscar C Jimenez
(74) *Attorney, Agent, or Firm* — Molex, LLC

(57) ABSTRACT

The present disclosure provides a conductive terminal and an electrical connector assembly. A high power electrical connector is provided for transmitting electrical signals from a pair of cables, such as high current capable cables, to an associated member, such as a dash panel. The high power electrical connector includes an insulative housing and a pair of contact path assemblies therethrough for transmission of the electrical signals. The cables include a shield layer that is biased to the backshell providing a ground path for the cables and connector.

20 Claims, 19 Drawing Sheets

(51) Int. Cl.

| | |
|---|---|
| ***H01R 13/15*** | (2006.01) |
| ***H01R 13/52*** | (2006.01) |
| ***H01R 13/53*** | (2006.01) |
| ***H01R 13/627*** | (2006.01) |
| ***H01R 13/639*** | (2006.01) |

(52) U.S. Cl.
CPC ..... *H01R 13/53* (2013.01); *H01R 13/627* (2013.01); *H01R 13/639* (2013.01); *H01R 13/6596* (2013.01); *H01R 2201/26* (2013.01)

(56) References Cited

U.S. PATENT DOCUMENTS 3,744,007 A * 7/1973 Horak ..... H01R 9/0521 174/75 C
3,990,765 A * 11/1976 Hill ..... H01R 4/64 439/607.51
4,243,290 A * 1/1981 Williams ..... H01R 9/032 439/607.52
4,598,969 A * 7/1986 Stephenson ..... H01R 13/6592 439/607.41
4,739,126 A * 4/1988 Gutter ..... H02G 3/065 174/655
4,854,891 A * 8/1989 Kamei ..... H01R 13/6584 439/462
5,222,909 A * 6/1993 Nomura ..... H01R 13/6582 439/271
6,702,611 B1 * 3/2004 Miyazaki ..... H01R 13/6593 439/559
7,789,690 B1 9/2010 Rhein
8,113,876 B1 * 2/2012 Rossman ..... H01R 13/6593 439/578
8,251,748 B2 * 8/2012 Tyler ..... H01R 13/648 439/607.52
9,510,491 B2 * 11/2016 Natter ..... H05K 9/0098
9,997,884 B1 * 6/2018 Matsumoto ..... H01R 4/027
2003/0003805 A1 * 1/2003 Yamamoto ..... H01R 9/035 439/607.41
2003/0207607 A1 * 11/2003 Matsumoto ..... H01R 13/6485 439/357
2008/0026639 A1 * 1/2008 Sardi ..... H01M 2/20 439/607.41
2008/0119088 A1 * 5/2008 Noh ..... H01R 9/0518 439/607.41
2009/0269981 A1 * 10/2009 Haruna ..... H01R 9/037 439/607.04
2010/0093231 A1 * 4/2010 Lauermann ..... H01R 13/5205 439/852
2012/0021645 A1 * 1/2012 Marsh ..... H01R 11/12 439/578
2012/0190238 A1 * 7/2012 Omae ..... H01R 9/0518 439/620.01
2012/0252272 A1 * 10/2012 Omae ..... H01R 13/648 439/607.01
2012/0270444 A1 * 10/2012 Kawamura ..... H01R 9/032 439/607.44
2013/0078835 A1 3/2013 Gunreben et al.
2014/0120768 A1 * 5/2014 Wetzel ..... H01R 13/6581 439/607.01
2014/0120772 A1 * 5/2014 Wetzel ..... H01R 13/6592 439/607.41
2014/0206213 A1 * 7/2014 Kato ..... H01R 13/533 439/157
2015/0118902 A1 4/2015 Data et al.
2015/0289420 A1 * 10/2015 Imahori ..... H01F 17/06 174/350
2017/0125950 A1 * 5/2017 Lloyd ..... H01B 11/00
2018/0034175 A1 * 2/2018 Lloyd ..... H01R 12/714
2018/0269623 A1 * 9/2018 Okamura ..... H01R 13/506

* cited by examiner

501

HIGH POWER ELECTRICAL CONNECTOR

RELATED APPLICATIONS

This application is a national stage of International Application No. PCT/US2017/013364, filed Jan. 13, 2017, which claims priority to U.S. Provisional Application No. 62/278,214 filed on Jan. 13, 2016, both of which are incorporated herein by reference in their entirety.

RELATED APPLICATIONS

Relatively large gauge cables (e.g., 6 gauge and larger) are coupled to a connector and for electric or hybrid vehicles the connector can be used to electrically connect the cables in an engine/motor compartment with the appropriate cables or wires on the opposite side of the dash panel. Similarly, these types of connectors are also used in industrial applications such as heavy machinery and farming equipment. Convention connectors have suffered from a number of issues. o the field of connectors, more specifically to the field of connectors suitable for delivery of high power.

DESCRIPTION OF RELATED ART

Relatively large gauge cables (e.g., 6 gauge and larger) are coupled to a connector and for electric or hybrid vehicles the connector can be used to electrically connect the cables in an engine/motor compartment with the appropriate cables or wires on the opposite side of the dash panel. Similarly, these types of connectors are also used in industrial applications such as heavy machinery and farming equipment. Convention connectors have suffered from a number of issues. On the one hand, the cables need to provide relatively large current—in the range of 80 to 200 amps (or more) along with the possibility of high voltages (200 Volts or more). This tends to require a cable with a large gauge conductor with good insulation that makes the cable relatively difficult to handle during assembly and repair of the vehicle. This issue can be further complicated by the fact that two separate cables can be connected to the connector. Existing designs, involve complicated assembly techniques and components leading to costly connector systems. Consequentially, further improvements to the design of high power electrical connectors would be appreciated by certain individuals.

BRIEF SUMMARY

A high power electrical connector is provided herein which provides improvements to existing high power electrical connectors and which includes embodiments that overcome certain of the disadvantages presented by the prior art. The high power electrical connector is provided for transmitting electrical signals from a pair of cables, such as bipolar (BP) cables, to an associated member, such as a dash panel. The high power electrical connector includes an insulative housing and contact path assemblies therethrough for transmission of the electrical signals. The cable is constructed from a large gage inner conductor that is surrounded by an insulator. A grounding or shielding layer is disposed around the insulator generally constructed from a braid or foil with an exterior insulating jacket surrounding the entire cable. The ground layer is connected to a conductive outer housing by a compression ring positioned between the cable insulator and ground layer. The connector includes a High Voltage Interlock, "HVIL", terminal retainer and strain relief mounting components.

BRIEF DESCRIPTION OF THE DRAWINGS

The current disclosure is illustrated by way of example and not limited in the accompanying figured in which like reference numerals indicate similar elements and in which.

DETAILED DESCRIPTION

Figure 1:
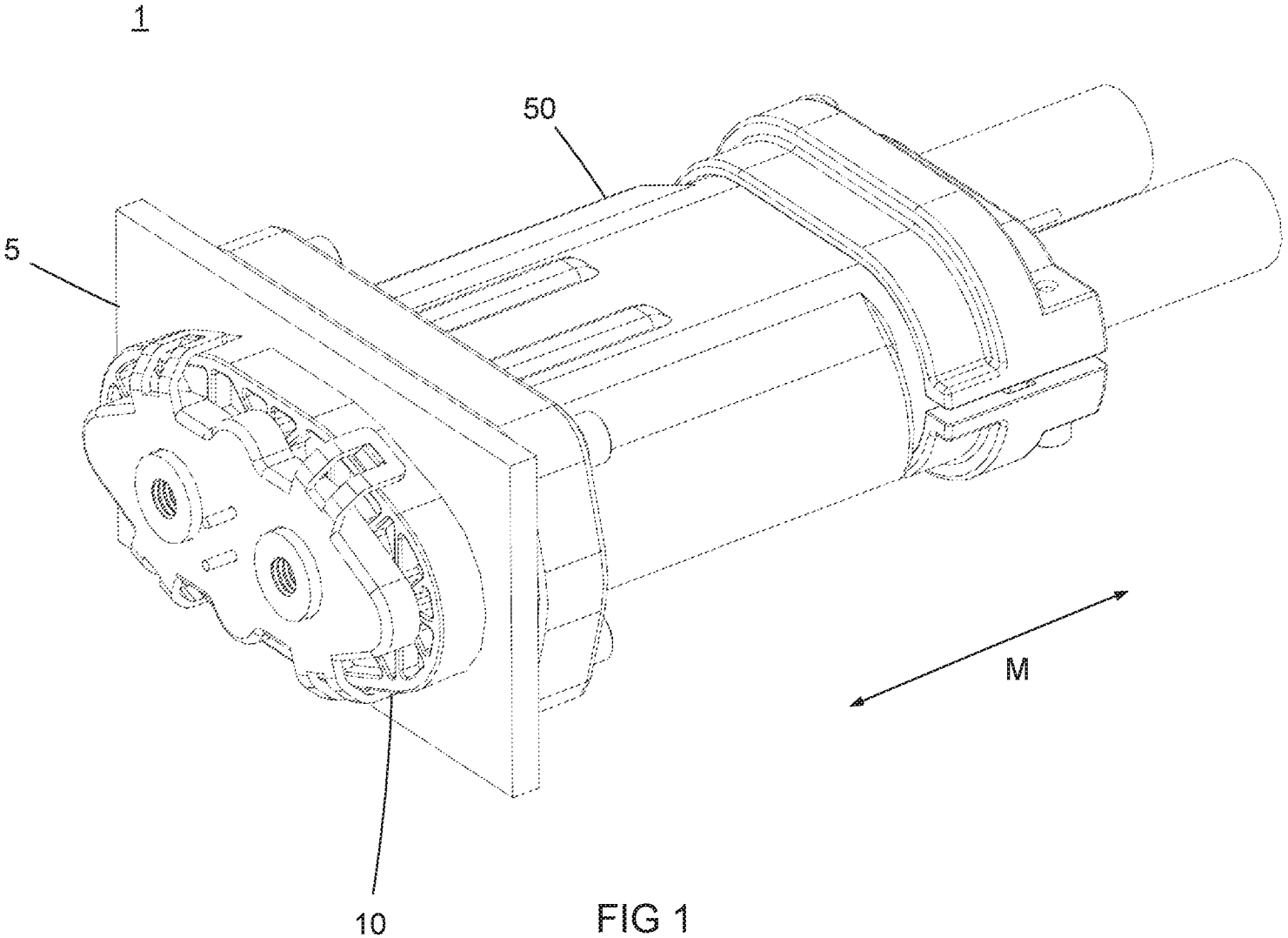
FIG. 1 is a perspective view of the connector of the present disclosure.
Figure 2:
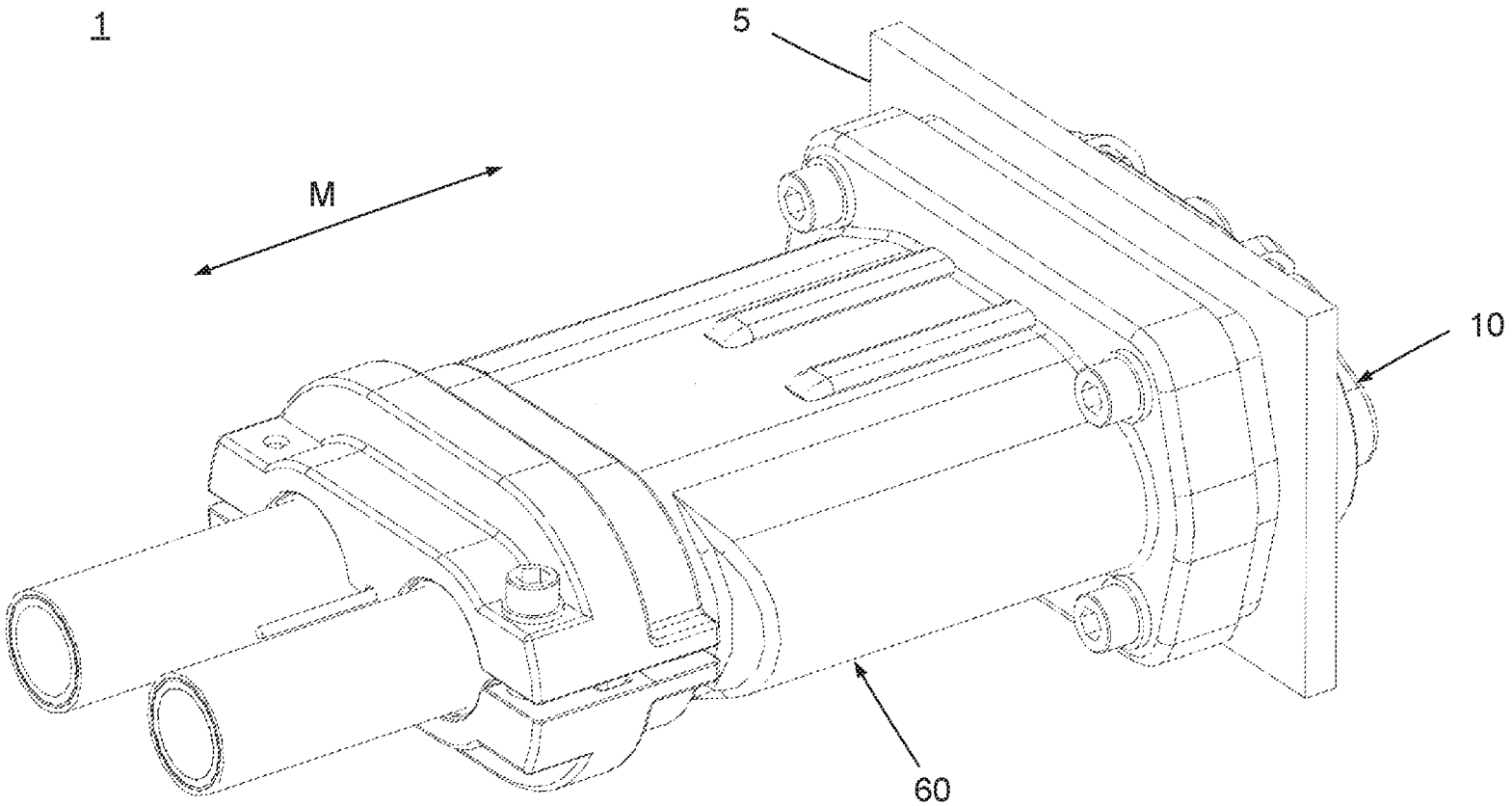
FIG. 2 is an alternative perspective view of the connector of FIG. 1.
Figure 3:
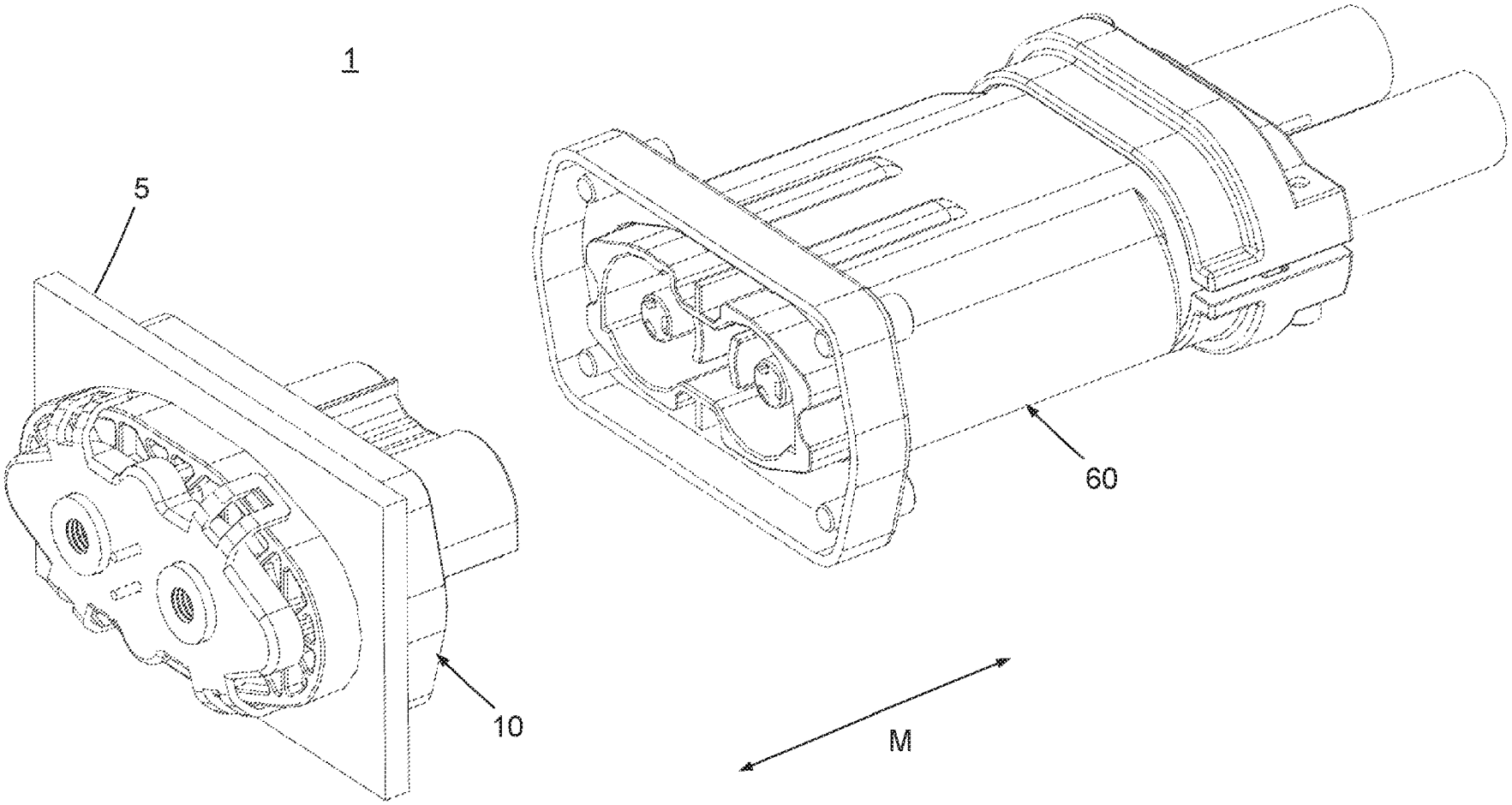
FIG. 3 is a perspective view of the connector of FIG. 1 with the plug and receptacle unmated.
Figure 4:
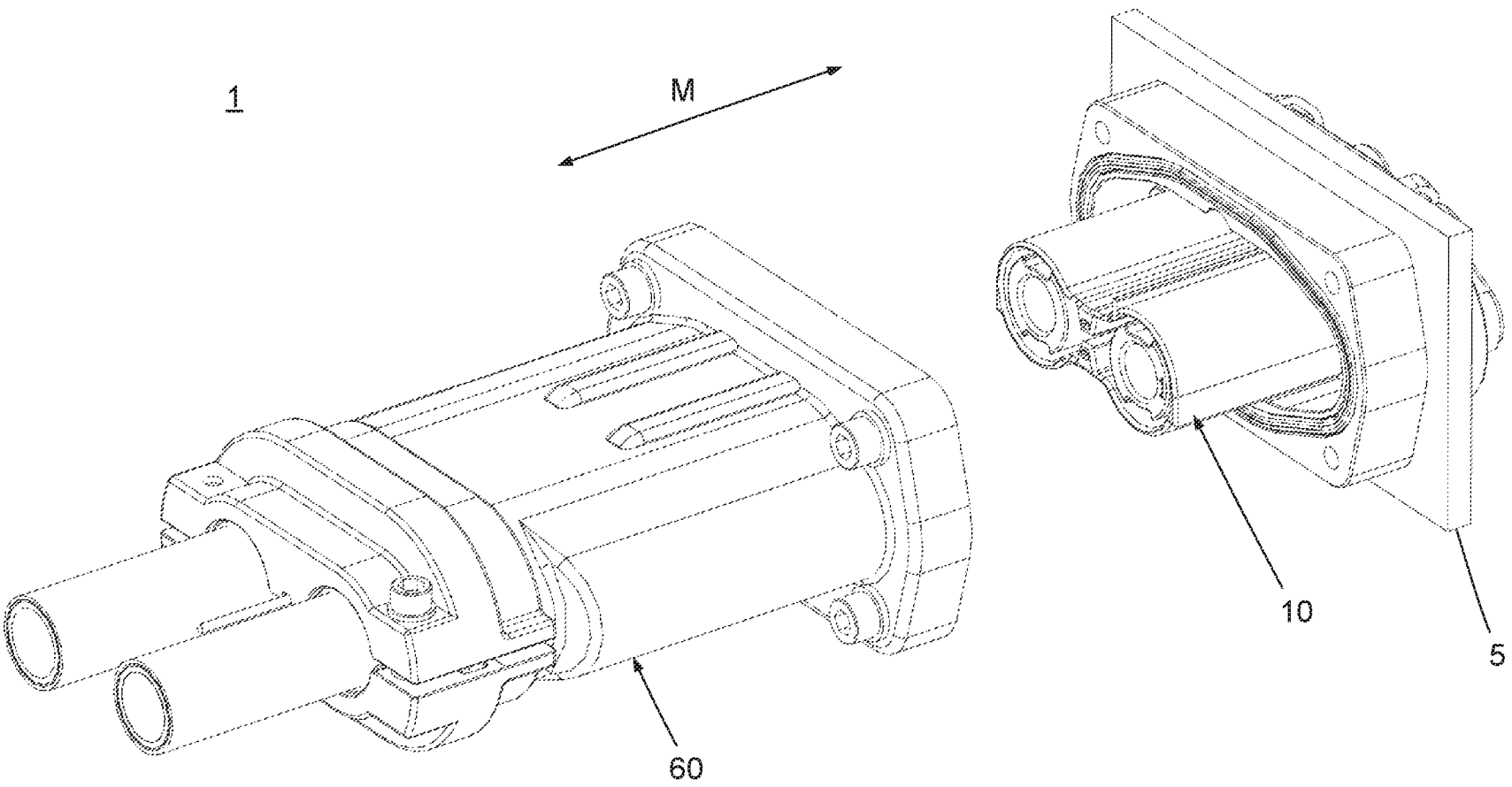
FIG. 4 is an alternative perspective view of the connector of FIG. 3.

The detailed description that follows describes exemplary embodiments and is not intended to be limited to the expressly disclosed combination(s). While the disclosure may be susceptible to embodiment in different forms, there is shown in the drawings, and herein will be described in detail, a specific embodiment with the understanding that the present disclosure is to be considered an exemplification of the principles of the disclosure. Therefore, unless otherwise noted, features disclosed herein may be combined together to form additional combinations that were not otherwise shown for purposes of brevity. While the terms upper, lower and the like are used herein, these terms are used for ease in describing the disclosure and do not denote a particular required orientation for use of the disclosure.

The appended figures illustrate a connector system. The connector system includes a plug and receptacle, each plug and receptacle having a housing and electrical contacts positioned in the housing. The contacts and housings are adapted to inter-engage providing secure mechanical and electrical connections. Typically, the connector system is used in an in-line cable or wire-to-wire type arrangement with respective electrical contacts connected to the cables. The system can be shielded or unshielded. In certain applications, one of the connectors may be secured to a panel such as a dash board or firewall found in automotive or industrial applications.

The use of two cables to provide power is known in the art and this is sometimes referred to bipolar (BP) cables. The cables are elongate and each includes an inner conductive conductor that is configured to carry a high current load, an insulative sheath surrounding the inner conductor, a conductive shield surrounding the insulative sheath, and an outer insulative jacket. The outer insulative jacket can be cut away to expose the conductive shield, as is known in the art, for grounding the cable.

As illustrated in the accompanying figures, a shielded version of the power connector is shown. A two circuit or bipolar cable is illustrated in the present disclosure and as shown in FIGS. 1-4. In applications requiring additional power, other circuit sizes are considered, that include additional cables as required. Three and four circuit connectors are typically used and are prevalent. The connector 1 includes a receptacle 10 and a plug 60 and is configured to be mated along a mating direction M. In the embodiment the connector is depicted as an in line wire to wire system. Other combinations and configurations are contemplated such as a wire to board arrangement and right angle versions of the receptacle and plug.

In addition to the high current cable interface, a second connection interface is also incorporated into the connector 1. A High Voltage Interlock or "HVIL" 30, 150 is also configured. Ground fault detection and a "high voltage interlock loop" continuously monitor the 120 volt AC wiring harness' integrity; a fault automatically shuts off the utility circuit's power.

Figure 5:
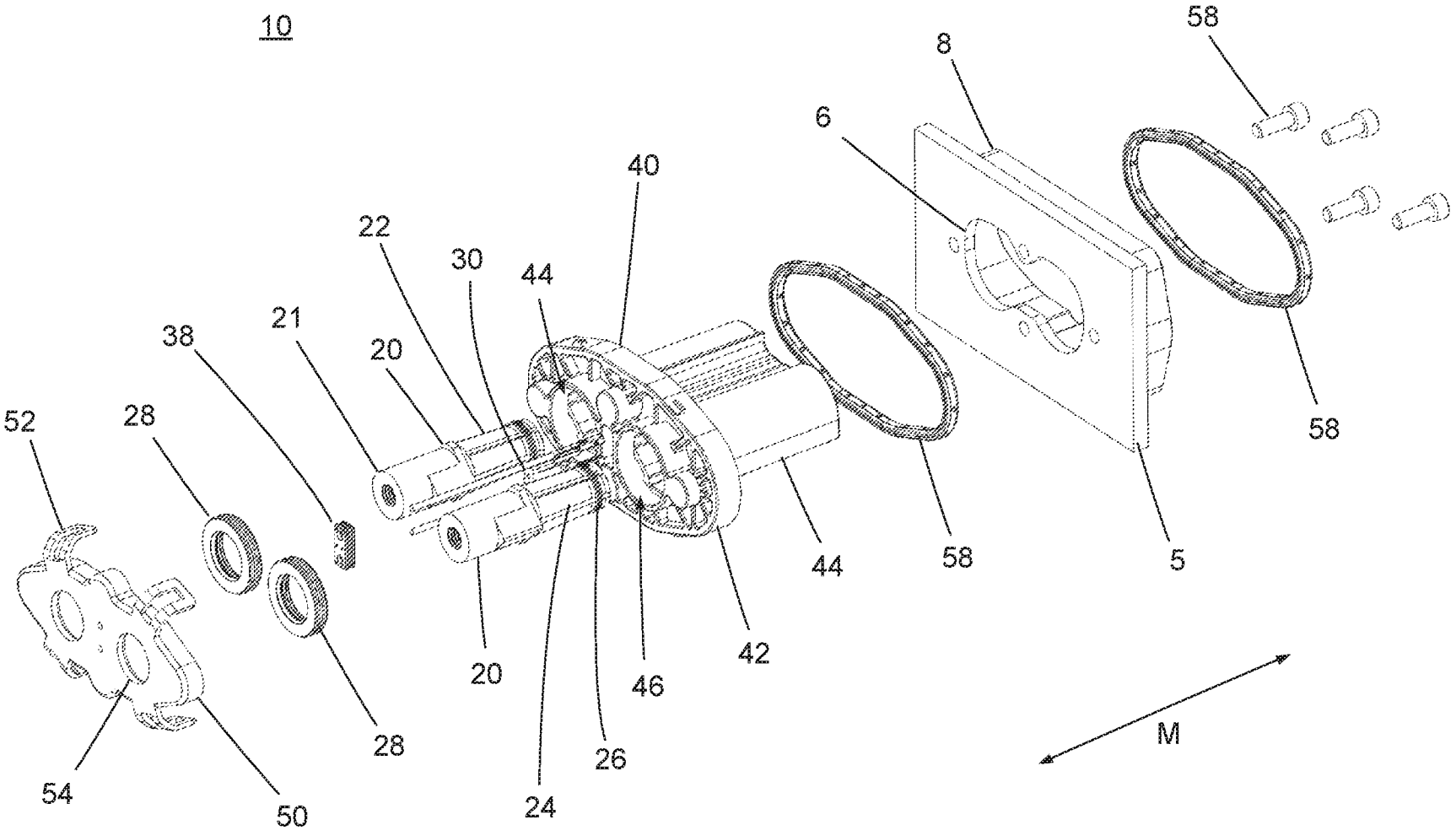
FIG. 5 is an exploded view of the receptacle of the connector of FIG. 1.

As best shown in FIG. 5 the receptacle 10 includes a housing 40 that is generally formed from an insulative material typically a molded polymer, a pair of conductive terminals 20 disposed in the housing 40, a pair of seals 28 fitted to an end of each terminal 20 and held in place by a cover 50. In the embodiment shown, the receptacle 10 is fitted onto a panel 5. The housing 40 is molded from a polymer and includes a flange 42 with an extension 44 protruding from the flange along a mating direction M. A pair of cavities 46 are formed in the flange 42 and extend into the extension 44. The conductive terminals 20 are inserted into the cavities 46 along the mating direction M.

Each conductive terminal is formed from a copper based alloy and is generally cylindrical in shape including a contacting portion 22 at one end and a mounting portion 21 at the other end. The contacting portion 22 includes a plurality of resilient spring fingers 24 disposed around the cylindrical periphery of the contacting portion 22 and defines a circular receiving space configured to receive a conductive male pin terminal upon mating. A circular reinforcing ring 26 is placed over the spring fingers 24 providing additional spring force to the spring fingers 24 upon deflection of the spring fingers 24 during mating. In the embodiment shown, the mounting end 21 includes a circular portion with a threaded holed for securing a conductor to the receptacle.

Once the terminals 20 are inserted into the cavities 46, a seal 28 is placed over the circular end of the terminal 20 proximate the mounting end 21. A cover 50 is mounted to the flange 42 of the housing 40 by securing latches 52. The cover includes a pair of apertures 54 corresponding to the location of the terminals 20 and allowing the mounting ends 21 of each terminal 20 to protrude from the exterior of the cover 50 allowing for attachment of an exterior conductor (not shown).

In the embodiment shown of the present disclosure, the receptacle 10 is mounted to panel 5. The panel includes a cutout portion 6 corresponding to the extension 44 of the housing 40 allowing the extension 44 to extend through the panel 5. A seal 58 is positioned between the panel and the receptacle flange 42 providing a moisture and debris barrier therebetween. A plurality of screws or bolts are used to mount and secure the receptacle housing 40 to the panel 5 and compress the seal 58. A shroud extends from an opposite side of the panel 5 and also includes a seal 58 providing a mating area for the plug 60.

Figure 6:
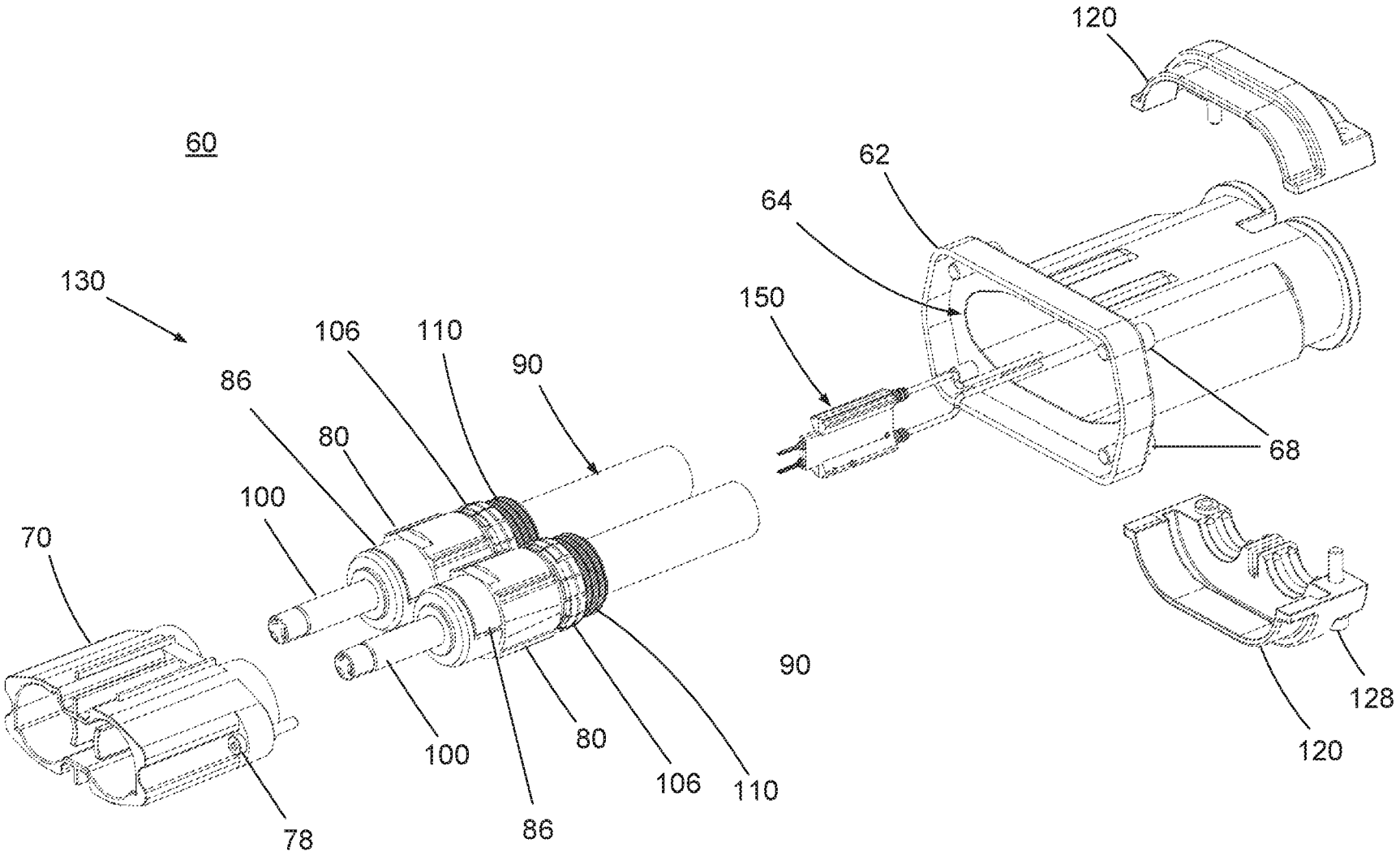
FIG. 6 is a partially exploded view of the plug of the connector of FIG. 1.
Figure 7:
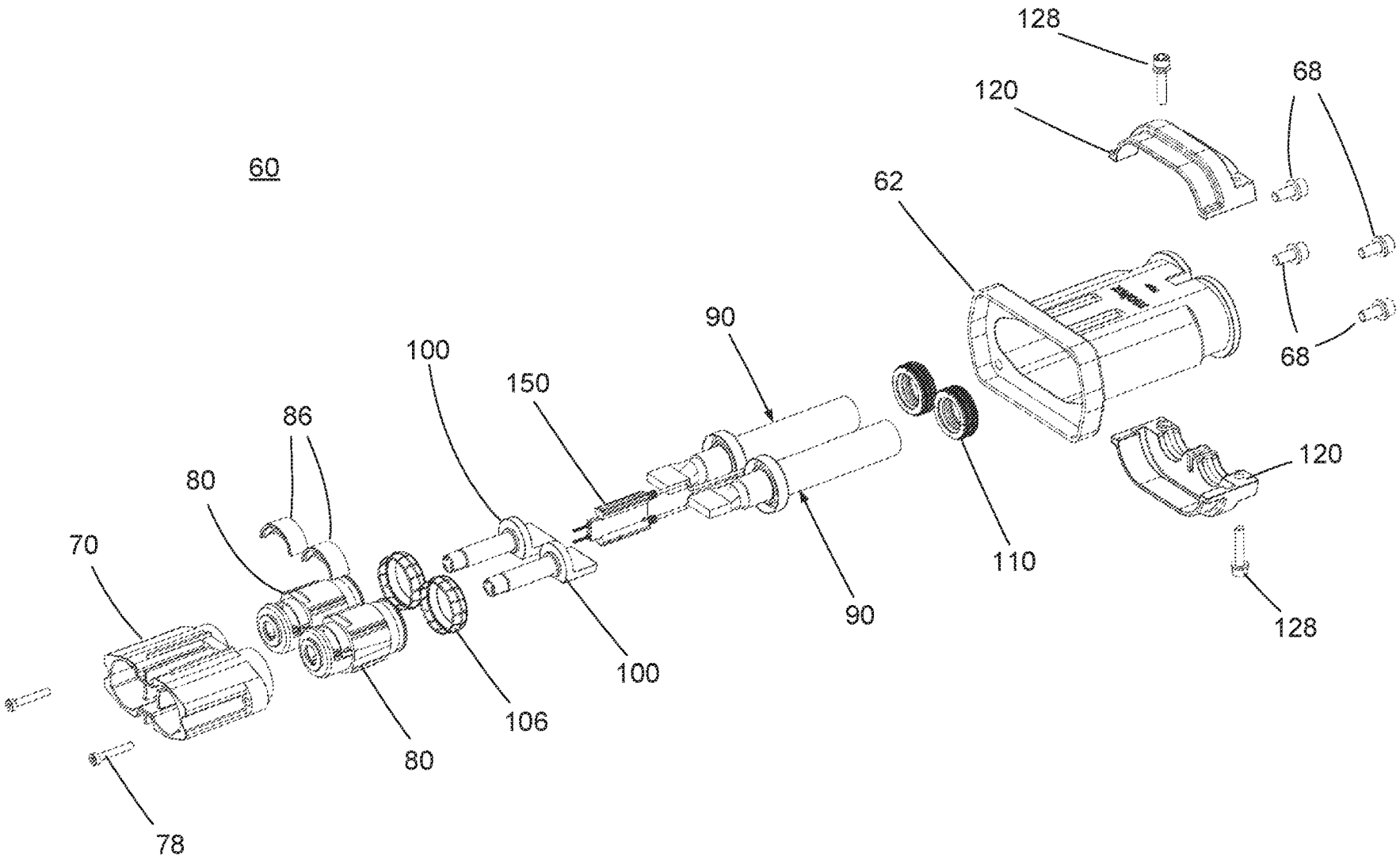
FIG. 7 is an exploded view of the plug of the connector of FIG. 1.

As best shown in FIGS. 6-7, the plug 60 of the connector 1 is illustrated. The plug includes a first housing 62 which is die cast from a conductive material, typically aluminum and includes a central opening 64. The opening 64 is configured to house a pair of terminal modules 130 and a HVIL 150 component. A second housing 70 is fitted over the terminal modules 130 and HVIL and secured to the first housing 62 and retain the terminal modules 130 and HVIL within the first housing 62. A strain relief 120 is fixed to first housing 62.

Figure 8:
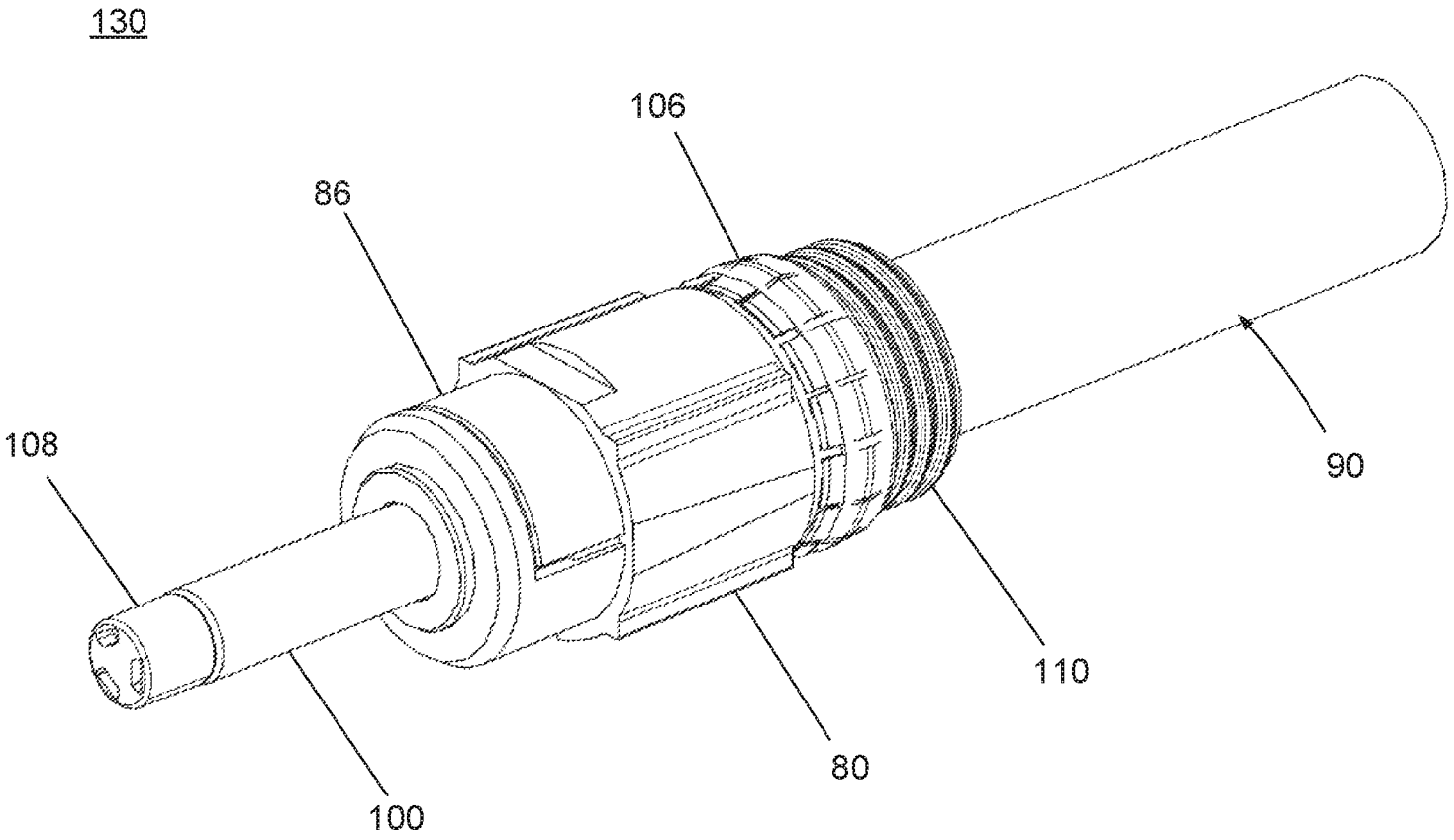
FIG. 8 is a perspective view of the terminal module of the plug of the connector of FIG. 1.
Figure 9:
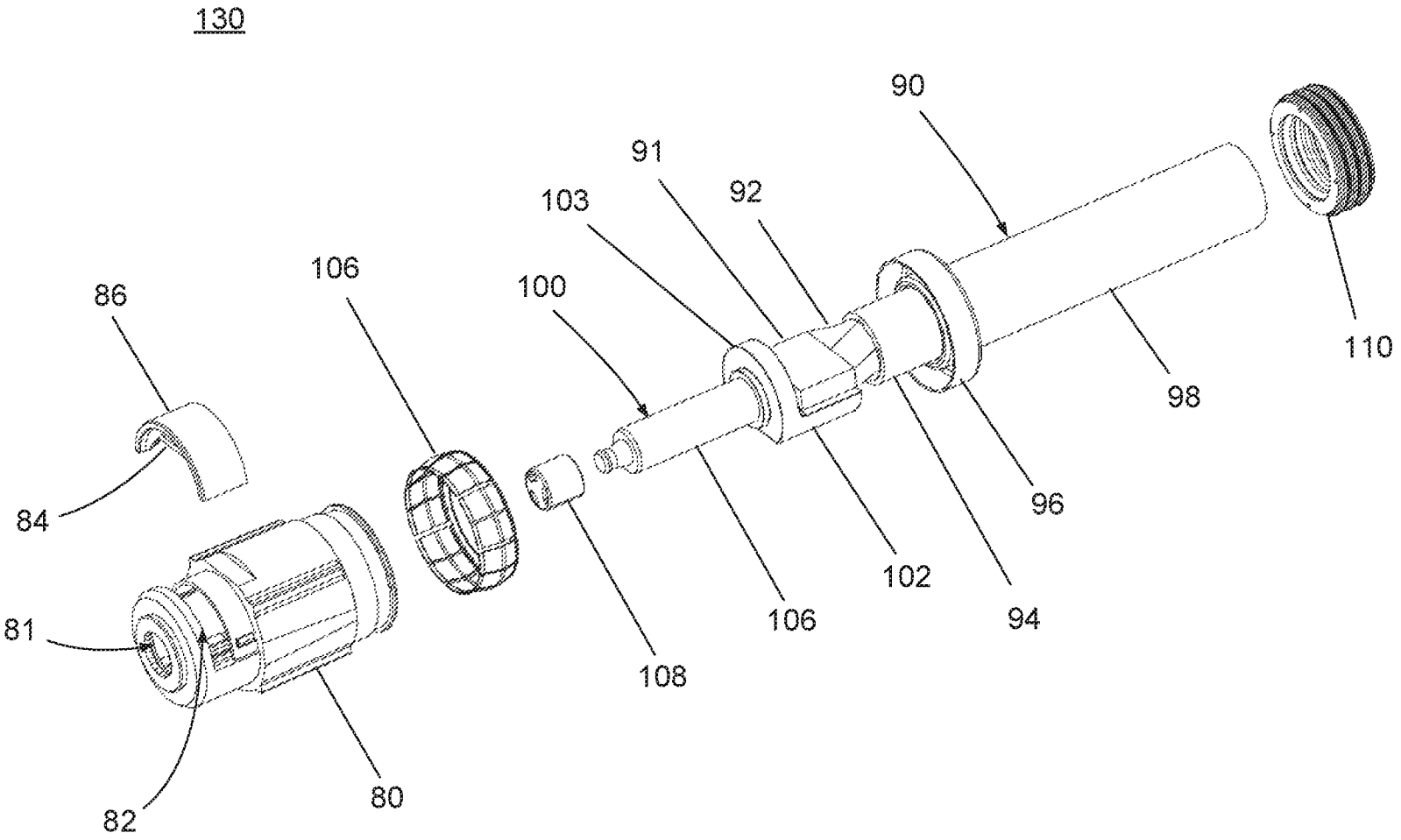
FIG. 9 is an explode view of the terminal module of FIG. 8.

As illustrated in FIGS. 8-9, the terminal module 130 includes a male pin terminal 100 formed from a conductive material, typically a copper based alloy. The terminal includes a contact portion 106 having a cylindrical shape configured to be mated with a corresponding mating terminal 20 of the receptacle 10. Adjacent the contact portion 106, a base 102 extends along the direction M. A shoulder 103 extends normally from the base 102 and is adjacent the contact portion 106. The terminal module 130 further includes a conductive cable 90. The cable includes a center conductor 92 that is surrounded by a sheath 94. The center conductor 92 can be of the stranded or solid type wire. Typically a stranded wire conductor is preferred for ease of bending and handling. A ground or shield layer 96 is disposed around the outer surface of the sheath 94 and is generally formed from a conductive foil or mesh. An outer insulative jacket 98 encases the entire cable.

As further illustrated in FIG. 9 the front portion 91 of the inner conductor 92 is welded to the base 102 of male terminal 100 formed a low resistance connection 93. During this process, the cable 90 must be dressed prior to the welding operation. To dress the cable 90, the outer jacket 98 is trimmed exposing the shield layer 96. The shield layer 96 is folded back over the remaining jacket 98 and exposes the sheath 94. The sheath 94 is stripped and the inner conductor 92 remains protruding from the end of the cable 90. At this point the inner conductor is welded to the terminal 100.

A terminal retainer 80 is formed from an insulative material and configured to receive the male terminal 100. The terminal retainer 80 includes a passageway 81 extending through the terminal retainer 80 with the male terminal received therein. During assembly, the male terminal 100 is inserted into the passageway 81 along the direction M wherein the contact portion 106 of the male terminal 100 extends through the passageway 81 and beyond the end of the retainer 80. A securing clip 86 is inserted through a window 82 formed in the a side of the retainer 80 with a locking shelf 84 orientated behind and abutting the flange 103 formed on the male terminal 100 thus locking the male terminal 100 in the retainer 80. A touch safe cap 108 is clipped to the end of the contact portion 106 of the male terminal 100 preventing accidental electrical shock to a user that handles the plug 60.

Figure 11:
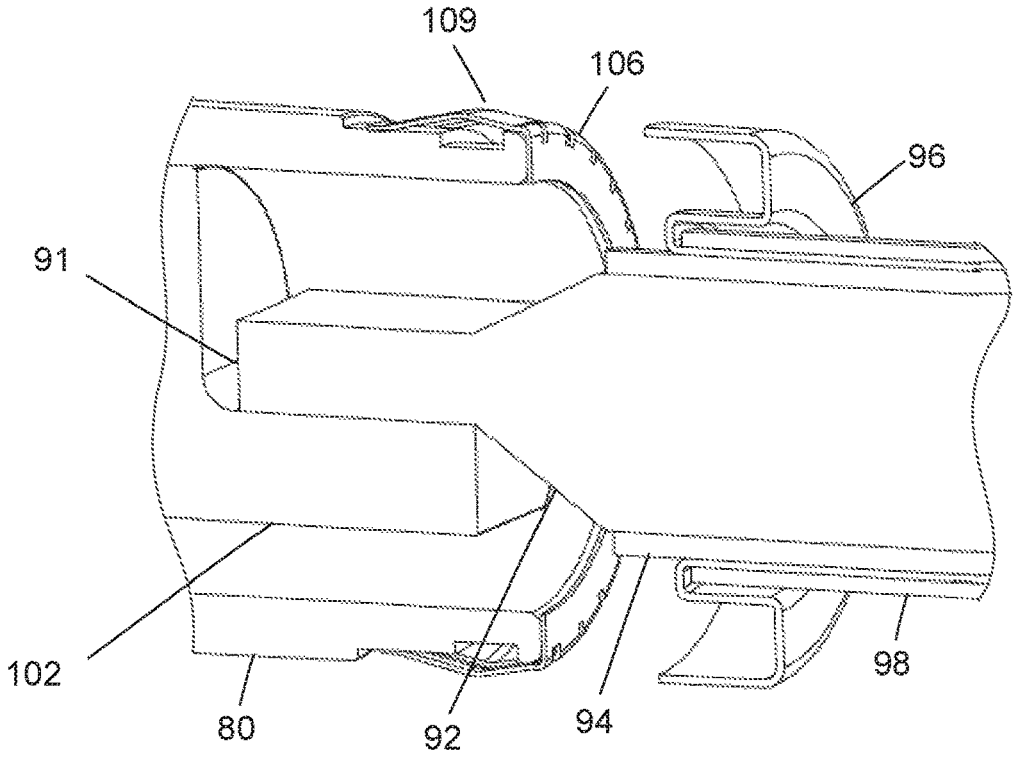
FIG. 11 is a detail view of the shield connection portion of the FIG. 10.
Figure 13:
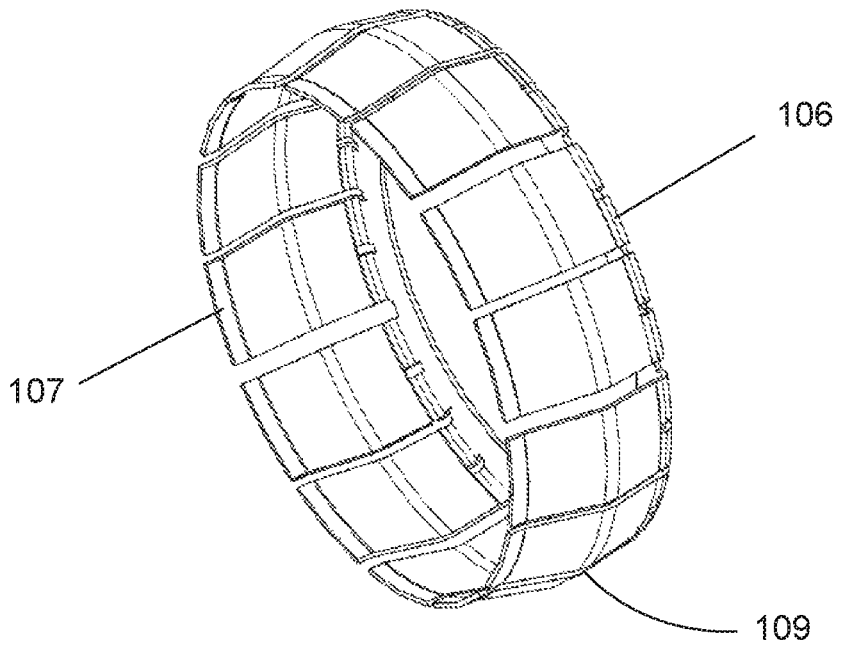
FIG. 13 is a perspective view of the compression ring of the plug.
Figure 14:
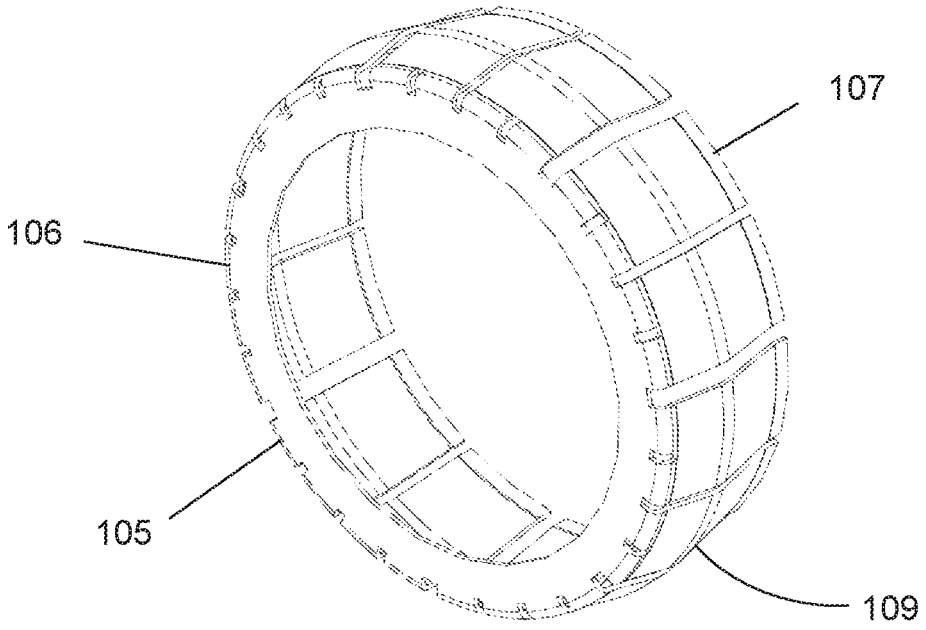
FIG. 14 is an alternative perspective of the compression ring of FIG. 13.
Figure 15:
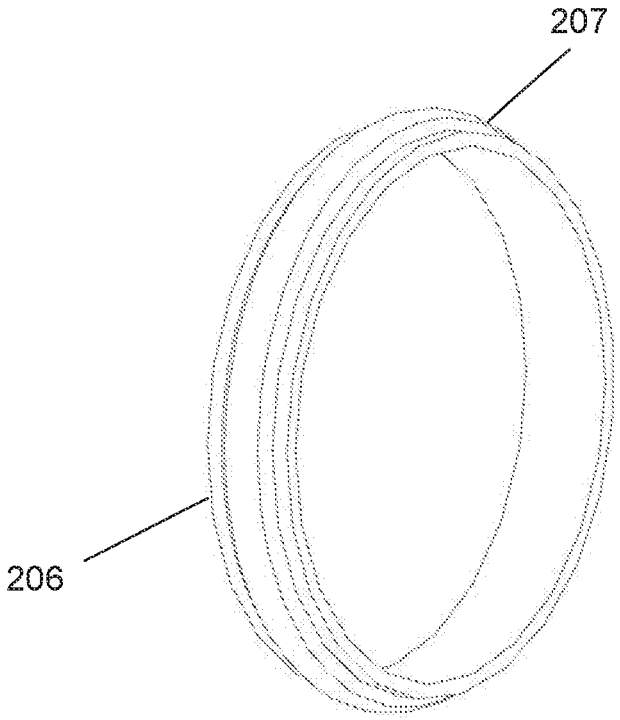
FIG. 15 is a perspective view of an alternative embodiment of the compression ring.

Upon assembly of the terminal module 130, a compression ring 106 is positioned between the terminal retainer 80 and shield layer 96. As best illustrated in FIG. 11, the dressing of the cable 90 and positioning of the compression ring 106 is depicted. In this figure the cable 90 is positioned slightly removed from the terminal retainer 80 for clarity. As illustrated in FIGS. 13-14 the compression ring 106 has a circular shape correspond to the general shape of the terminal retainer 80. The compression ring 106 has a base 105 having a surface normal to the mating direction M and a plurality of flexible spring fingers 107 extending from the base 105 and positioned around the periphery of the base 105 forming an "L" shaped cross section. Each spring finger 107 is cantilevered from the base portion 107 and includes a raised contact point 109 generally positioned in the middle of the spring finger 107. An alternative compression ring 206 is shown in FIG. 15. The compression ring 206 is formed from and elastomeric material having a degree of flexibility and has a raised contact point 207 formed around the retaining ring 206.

Once the retaining ring 106 is place on the retainer 80, the terminal 100 and the dressed cable 90 is inserted into the passageway 81 of the retainer 80. At this time, the shield layer 96 also is inserted into the passageway 81 with a portion of the shield layer 96 extending away from the retainer 81. The remaining portion of the shield layer 96 is then folded over the exterior surface of the retaining ring 106. In this arrangement, the spring fingers 107 of the retaining ring 106 are positioned between the exterior of the retainer 80 and the remaining portion of the shield layer 96 that is now folded over the spring fingers 107.

Figure 10:
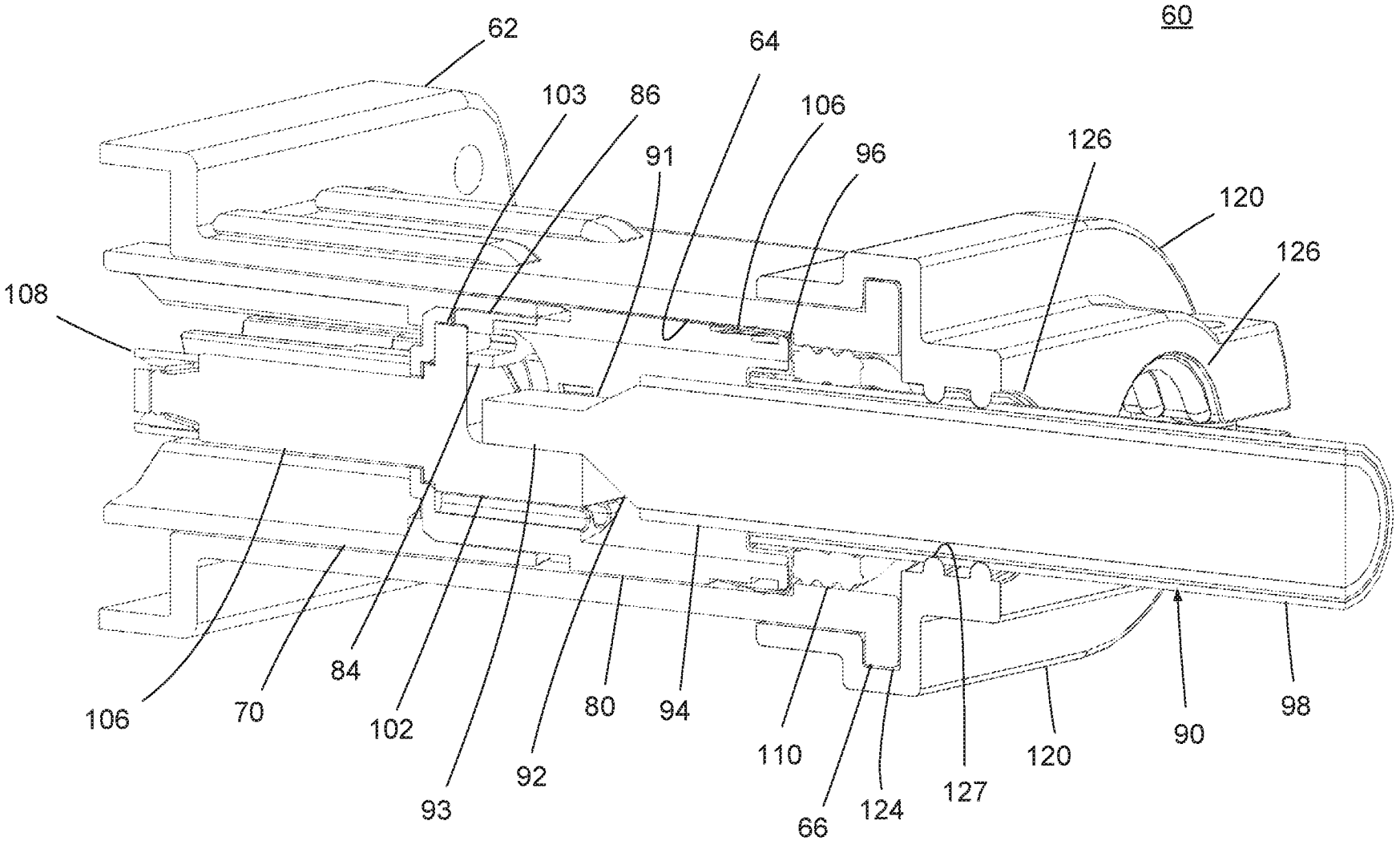
FIG. 10 is a section view of the plug of the connector of FIG. 1.
Figure 12:
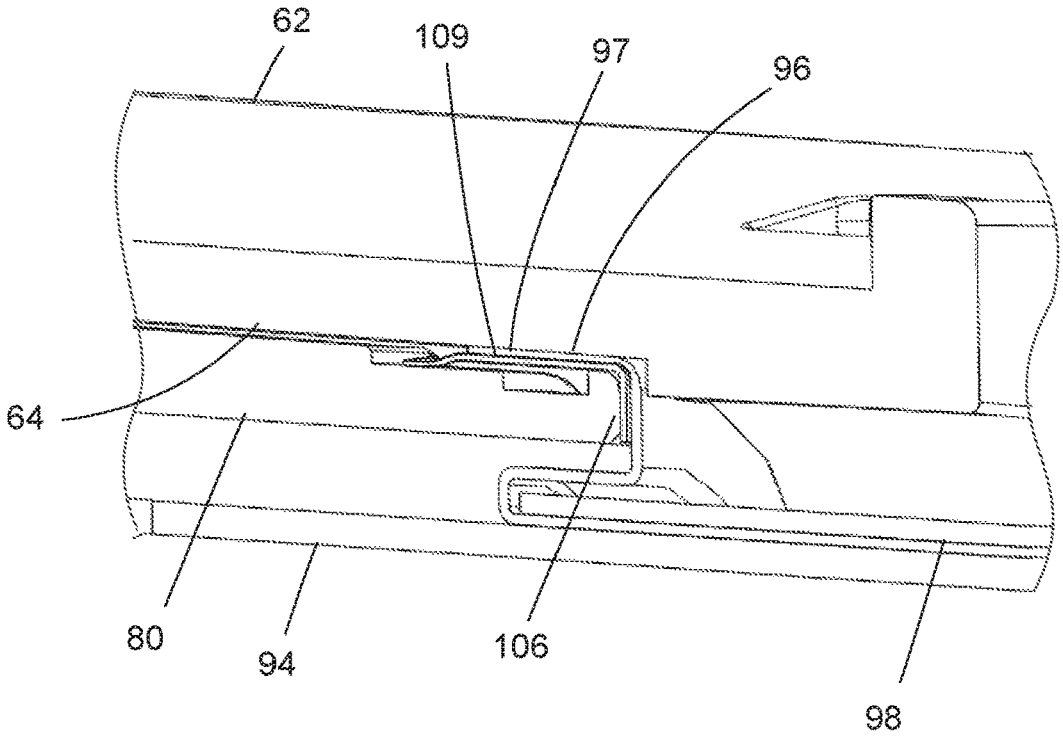
FIG. 12 is another detail view of the shield connection portion of FIG. 10.
Figure 16:
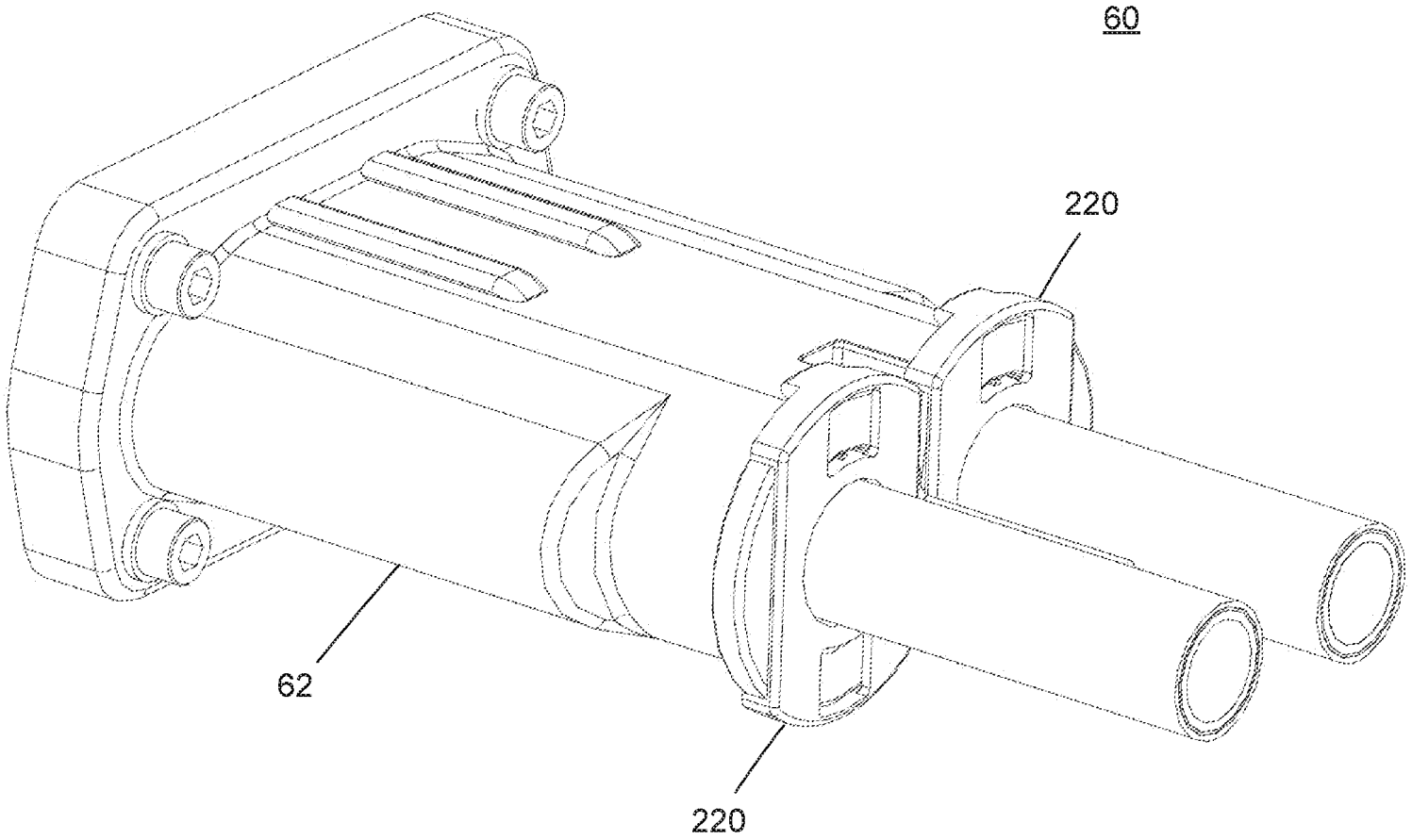
FIG. 16 is a perspective view of the plug without a strain relief.
Figure 17:
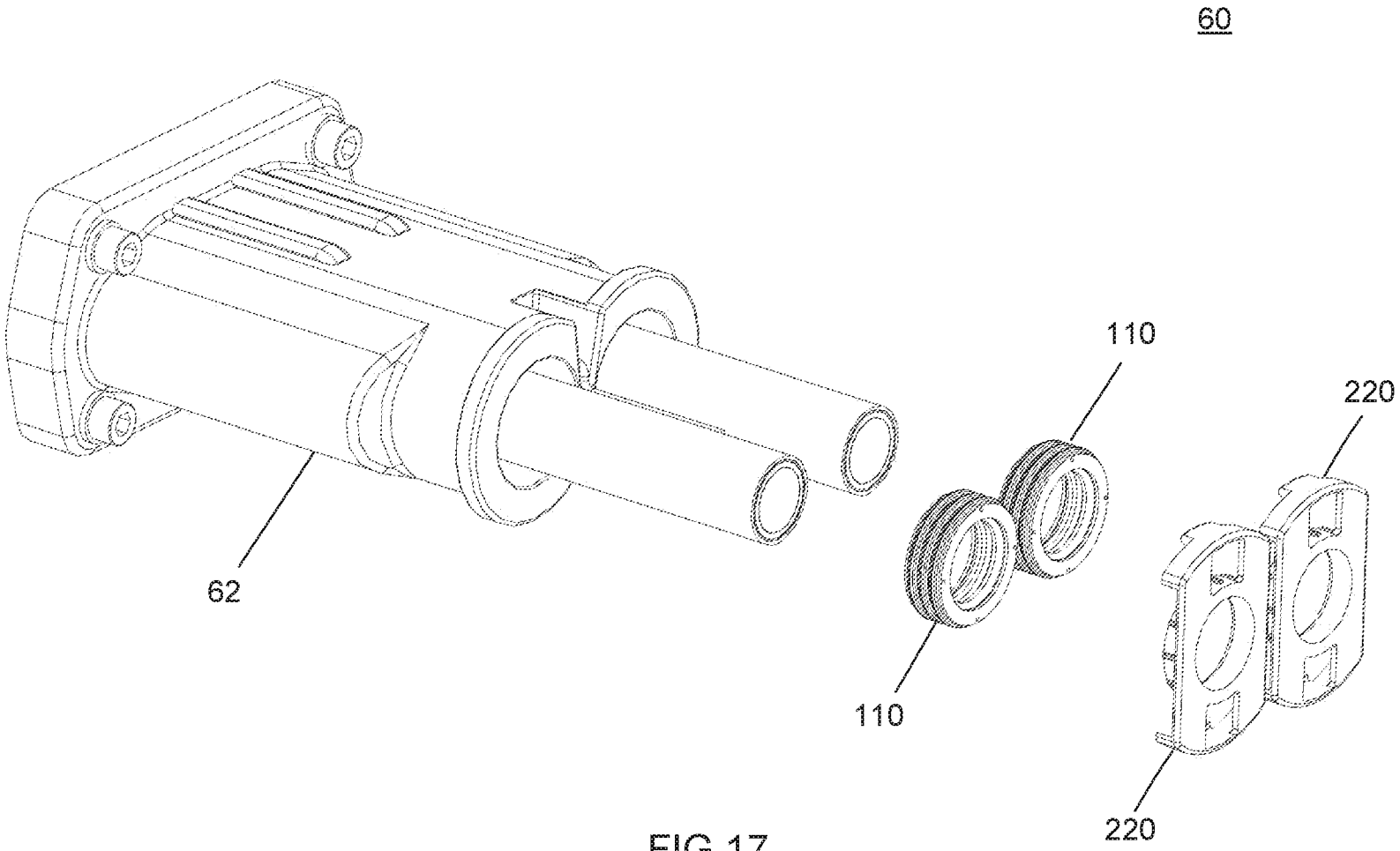
FIG. 17 is an partial exploded view of the alternative embodiment of the plug of FIG. 16.

FIGS. 10 and 12 show a cross section of the completed plug 60 assembly. The completed plug assembly 60 involves the step of inserting the terminal module 130 into the backshell 62 and finally securing the terminal module 130 in place. As previously described, the terminal 100 is welded to the cable 90, the cable 90 is dressed so that the shield layer 96 is properly positioned over the compression ring 106 and subsequently, the completed terminal module is then inserted into the backshell 62 along the direction M. As shown in FIG. 12 the final position is illustrated. In this position, the shield layer 96 is interleaved between an inner surface 65 of the backshell 62 and the contact point 109 of the compression ring 106. In this arrangement, the compression ring biases the shield layer 96 against the electrically conductive surface 65 of the backshell 62 maintaining an electrical ground path between the cable 90 and the backshell 62 of the receptacle 60. The housing 70 is then placed in the opening 64 engaging each terminal retainer 80 and aligning the contact portions 106 of the terminals 100. A pair of screws 78 protrude through the housing and engage the backshell 62 sandwiching the terminal modules 130 therebetween and securing the receptacle 60 together A strain relief 120 is attached to the backshell 62 at a cable exit portion 126 of the backshell 62. A pair of stain relief housings 120 are positioned over the rear portion of the backshell 62 wherein a shoulder 66 formed on the backshell engages a recess 124 formed in the backshell 62 locking the strain relief 120 to the backshell 62. An annular protrusion 127 is formed in the cable exit portion 126 of the backshell 62 that engages the cable 90. Screws 128 secure the strain relief housings 120 together and urge the projections 127 into compressive contact with the cable 90 and secure the cable to the backshell 62. In this arrangement, any pull forces acting on the cables 90 are transferred to the backshell 62 and minimize or eliminate any stress on the connection between the cable 90 and the terminals 100. An alternative embodiment is shown in FIGS. 16-17 in which a strain relief structure is not implemented. In this embodiment a seal cover 220 is placed over the cable exit portion of the backshell 62 that maintains the position of the seals 110 within the backshell 62.

Figure 18:
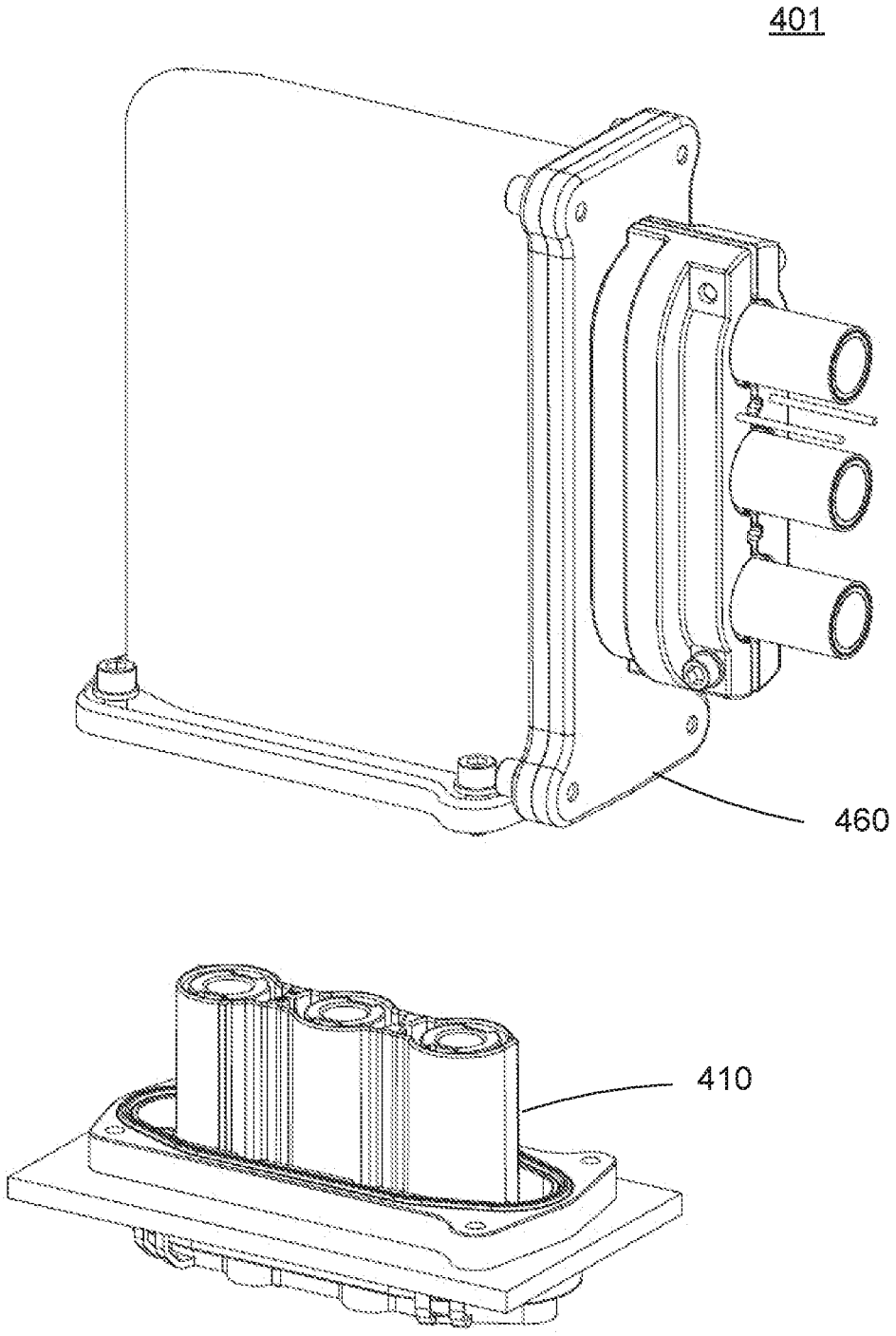
FIG. 18 is a perspective view of an alternative embodiment of the connector of the present disclosure.
Figure 19:
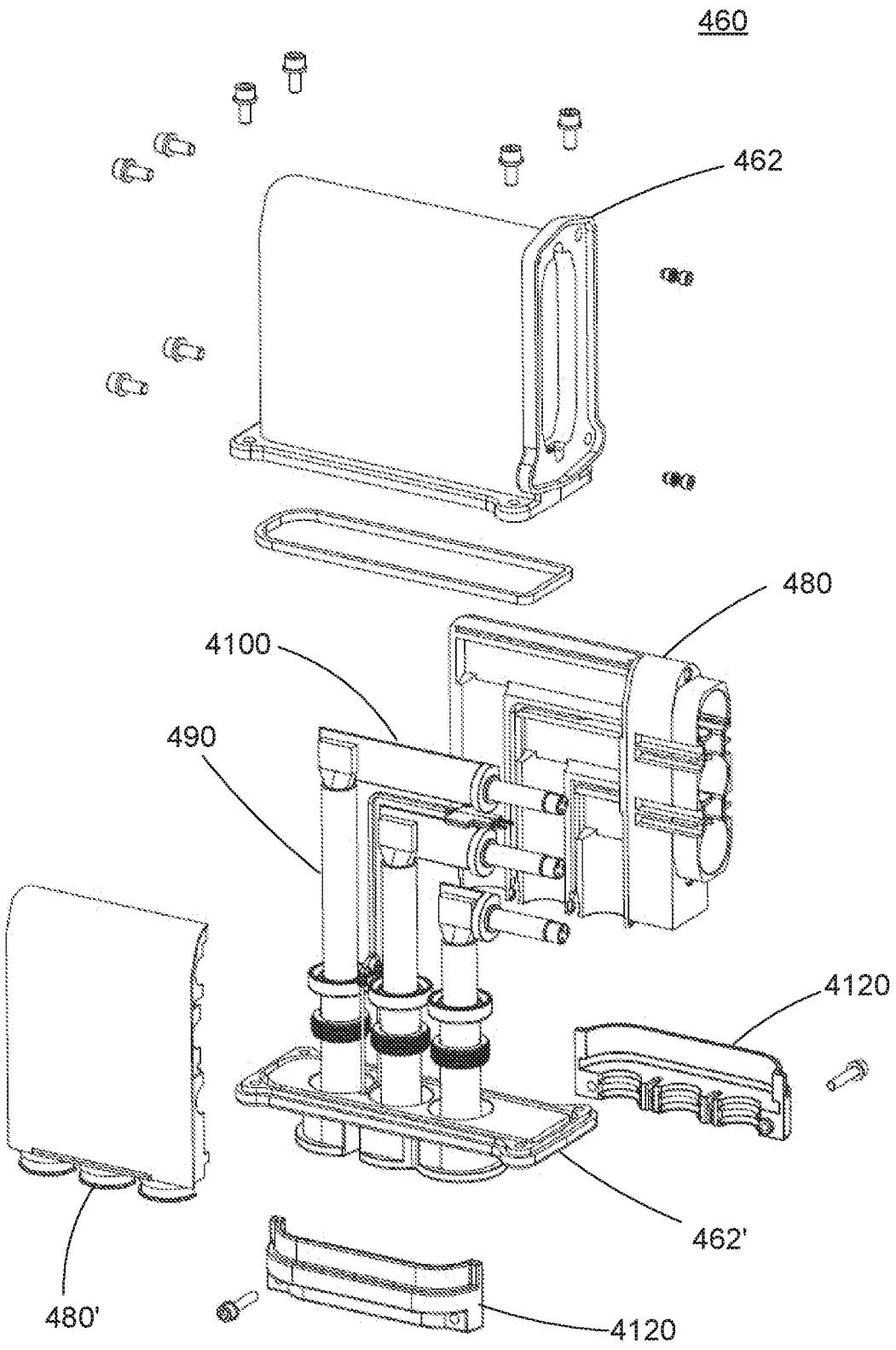
FIG. 19 is an exploded view of the alternative embodiment of FIG. 18.

As illustrated in FIGS. 18-19, a three circuit, right angle version of is shown. In this version, the plug 460 includes cables 490 that are arranged in a vertical fashion. In this instance the harness or plug 460 has the cables 490 exit at an angle to the insertion or mating direction. As best shown in FIG. 19 the electrical contacts 4100 each have a wire mounting portion to which the cable 490 is secured. The cables 490 are typically welded or soldered to the mounting portion and extend at right angles to the mating direction. Similarly, an HVIL 4150 is configured in the housing 480 in addition to a cable strain relief 4120 disposed on the cable exit portion of the backshell 462 along with cable and interface sealing structures. In this arrangement, the housing of the plug is a clam-shell configuration having base 480 and cover 480' portions that are secured within a die cast outer housing or backshell 462.

In this embodiment, the connection between the cable shield layer and the backshell is the same as previously described in the in-line version above. A compression ring is disposed between the housing and the shield layer and upon insertion in the backshell, the compression ring biases the shield layer to the back shell.

The assembly of the plug 460 in this embodiment includes the cables 490 and terminals 4100 first being welded together and then the grommets, seals, and grounding clamp are positioned on the cables 490. The cable sub-assemblies are positioned in the main housing 480 with the housing cover 480' secured to the main housing by screws or snap fits. The housing assembly is inserted into the diecast backshell 462 and the diecast cover 462' is disposed over the cables and fastened onto the backshell 462. The cable strain relief 4120 is secured to the backshell 462, 462' and cables 490 providing a stain relief.

Figure 20:
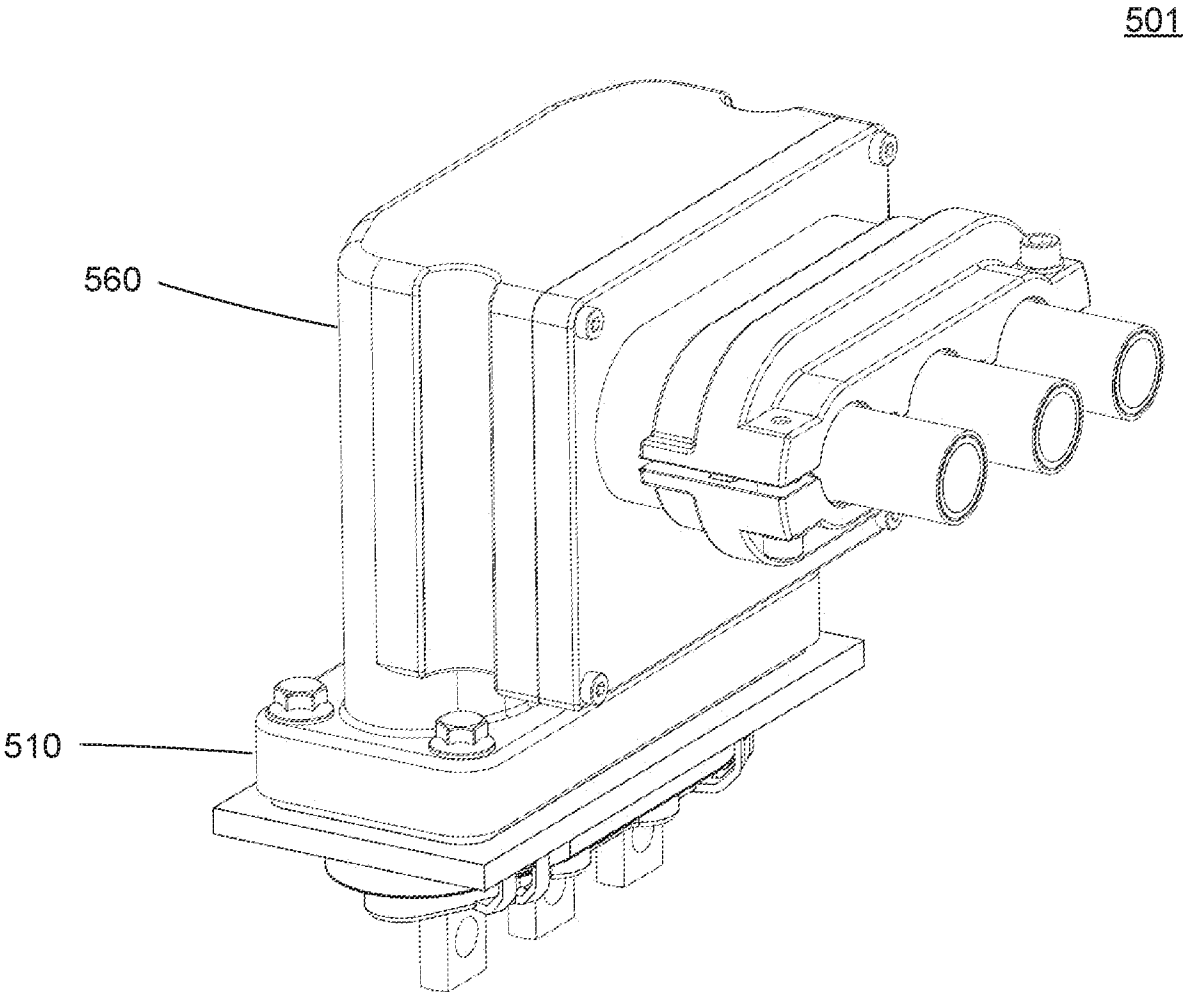
FIG. 20 is a perspective view of another alternative embodiment of the connector of the present disclosure.
Figure 21:
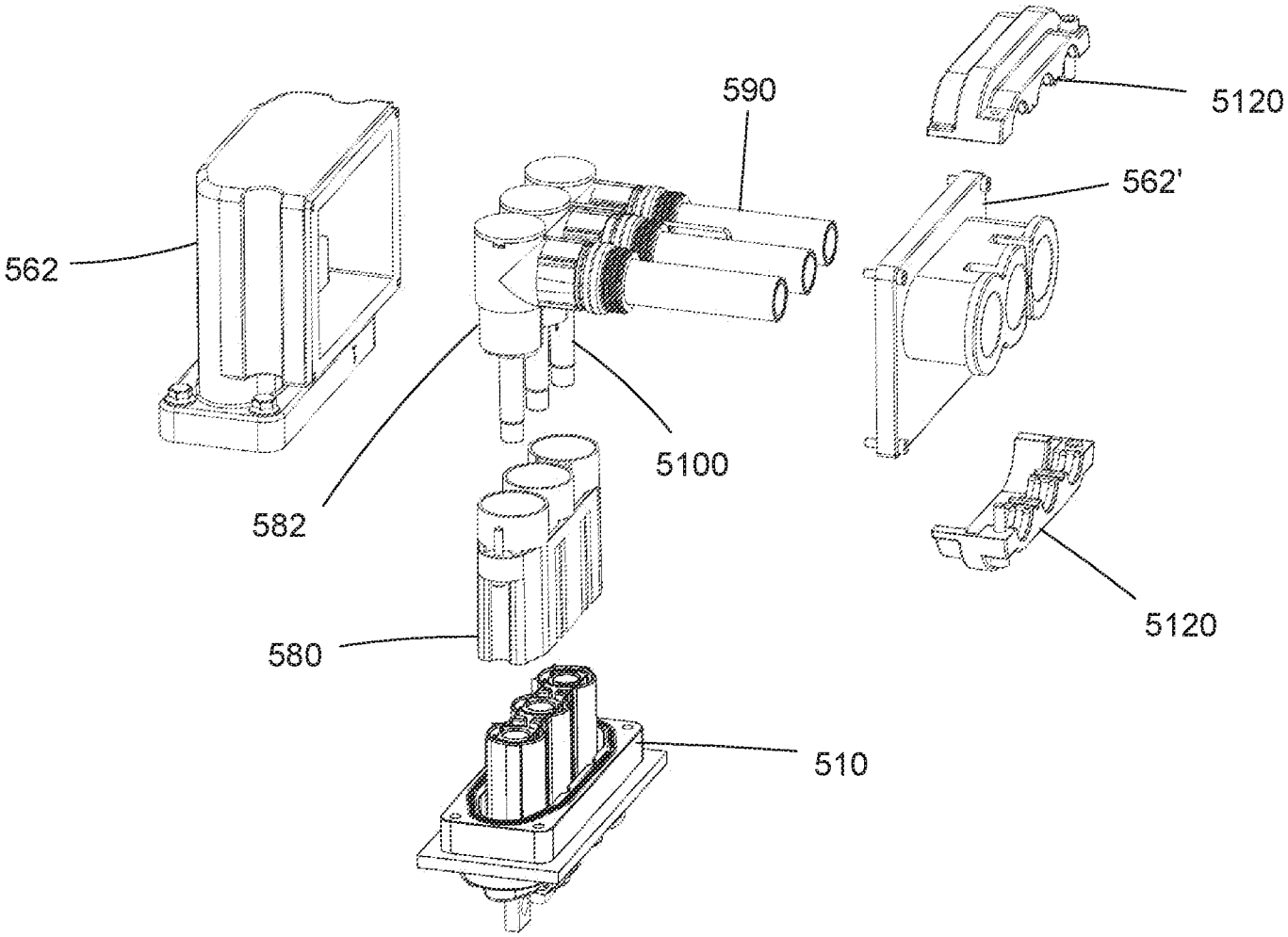
FIG. 21 is an exploded view of the alternative embodiment of the connector of FIG. 20.

As further illustrated in FIGS. 20-21, a second right angle version is depicted. In this arrangement the cables 590 and terminals 5100 are arranged in a horizontal or longitudinal fashion. Similarly, the cables 590 are welded to the electrical terminals 5100 at a right angle to the mating direction. As best shown in FIG. 21, the plug 560 is shown in an exploded view illustrating the components of the plug 560. In this case, the cables 590 and terminals 5100 are retained in an individual housing 580 and arranged in a side-by-side manner. The cable sub-assemblies are loaded into the backshell 562 and a cover 562' is secured to the backshell 562. Additionally, an "HVIL" is also configured in the mating interface of the plug 560.

As depicted in FIG. 21, the assembly of the connector is shown. Initially, the cables 590 are welded to the mounting portion of the electrical terminals 5100 and secured in an individual housing 582 with the seals and cable shields disposed on the cables. As described in the previous embodiments a compression ring is disposed between the housing and the shield layer and upon insertion in the backshell 562, the compression ring biases the shield layer to the backshell cover 562'.

The cable sub-assemblies and the "HVIL" connector are then inserted into the backshell 562 in such a manner as to first insert the front portions of the cable assemblies through an opening in the backshell 562 and then pivot the backshell 562 over the rear portion of the cable sub-assemblies. The backshell cover 562' is disposed over the cables and fastened to the backshell 562. The housing 580 is then secured to the backshell 562 by screws. A cable strain relief 5120 is then secured over the exit portion of the plug 560 providing strain relief to the cables 590.

The embodiments provided herein address certain issues that Applicants have determined exist in existing designs. Numerous other embodiments, modifications and variations will occur to persons of ordinary skill in the art from a review of the disclosure. Thus, various levels of connectors with various levels of features are possible.

What is claimed is:

1. A high power electrical connector comprising:

a conductive backshell, the backshell having an opening;

an insulative retainer;

a cable, the cable having an inner conductor, an insulative sheath surrounding the inner conductor, a conductive shield disposed over the insulative sheath and an exterior insulative jacket, the inner conductor and the shield being exposed, the cable configured to be inserted into the retainer with a portion of the exposed conductive shield disposed within the retainer;

a compression ring, the compression ring positioned on the retainer and a second portion of the conductive shield folded over the compression ring and disposed between the insulative retainer and the backshell; and wherein upon insertion of the insulative retainer and the cable into the backshell opening, the compression ring urges the second portion of the conductive shield into contact with the backshell.

2. The high power electrical connector of claim 1, wherein the compression ring surrounds the retainer.

3. The high power electrical connector of claim 2, wherein the compression ring includes a raised contact point.

4. The high power electrical connector of claim 3, wherein the compression ring is formed from an elastomeric material.

5. The high power electrical connector of claim 3, wherein the compression ring is formed from stainless steel.

6. The high power electrical connector of claim 5, wherein the compression ring includes a plurality of spring fingers extending from a base of the compression ring and spaced around the compression ring.

7. The high power electrical connector of claim 6, wherein the compression ring has an "L" shaped cross section.

8. The high power electrical connector of claim 1, wherein a strain relief is secured to the backshell and engages the cable.

9. The high power electrical connector of claim 1, wherein a male terminal is locked in the retainer.

10. The high power electrical connector of claim 9, wherein the male terminal is welded to the inner conductor.

11. The high power electrical connector of claim 9, wherein an insulative cap is disposed on the male terminal.

12. The high power electrical connector of claim 1, where a seal is positioned between the cable and the backshell.

13. A high power electrical connector comprising:

first and second cables, each cable comprising an outer insulative jacket, a conductive shield, a sheath and an inner conductive conductor, the inner conductor and the conductive shield being exposed;

a backshell having a pair of passageways into which the cables are seated;

a first seal between the backshell and the first cable;

a second seal between the backshell and the second cable;

a first contact assembly extending through the backshell for transmitting electrical signals through the backshell, the first contact assembly comprising, a first retainer mounted in the backshell, a first terminal mounted in the retainer connected to the inner conductor of the first cable, a first compression ring mounted on the first retainer and contacting a portion of the exposed conductive shield of the first cable, a second portion of the conductive shield of the first cable is disposed between the first compression ring and the backshell;

a second contact assembly extending through the backshell for transmitting electrical signals through the backshell, the second contact assembly comprising, a second retainer mounted in the backshell, a second terminal mounted in the retainer connected to the inner conductor of the second cable, a second compression ring mounted on the second retainer and contacting a portion of the exposed conductive shield of the second cable, a second portion of the conductive shield of the second cable is disposed between the second compression ring and the backshell; and;

a housing secured to the backshell to hold the first and second retainers in the backshell.

14. The high power electrical connector of claim 13, wherein each compression ring surrounds each of the respective retainers.

15. The high power electrical connector of claim 14, wherein each compression ring includes a raised contact point.

16. The high power electrical connector of claim 15, wherein each compression ring is formed from an elastomeric material.

17. The high power electrical connector of claim 15, wherein each compression ring is formed from stainless steel.

18. The high power electrical connector of claim 17, wherein each compression ring includes a plurality of spring fingers extending from a base of the compression ring and spaced around the compression ring.

19. The high power electrical connector of claim 18, wherein the compression ring has an "L" shaped cross section.

20. The high power electrical connector of claim 13, wherein each cable is welded to each respective terminal.

* * * * *